US011927383B2

(12) United States Patent
Newman et al.

(10) Patent No.: US 11,927,383 B2
(45) Date of Patent: Mar. 12, 2024

(54) IMPINGEMENT FREEZER WET COOL DOWN

(71) Applicant: Messer Industries USA, Inc., Bridgewater, NJ (US)

(72) Inventors: Michael D. Newman, Hillsborough, NJ (US); Christopher Pastore, Somerset, NJ (US)

(73) Assignee: Messer Industries USA, Inc., New Castle, DE (US)

( * ) Notice: Subject to any disclaimer, the term of this patent is extended or adjusted under 35 U.S.C. 154(b) by 0 days.

(21) Appl. No.: 16/693,847

(22) Filed: Nov. 25, 2019

(65) Prior Publication Data

US 2020/0191465 A1 Jun. 18, 2020

Related U.S. Application Data

(60) Provisional application No. 62/779,085, filed on Dec. 13, 2018.

(51) Int. Cl.

| | |
|---|---|
| ***F25D 21/06*** | (2006.01) |
| ***F25D 3/11*** | (2006.01) |
| ***F25D 13/06*** | (2006.01) |
| ***F25D 21/14*** | (2006.01) |

(52) U.S. Cl.

CPC ..... *F25D 21/065* (2013.01); *F25D 3/11* (2013.01); *F25D 13/06* (2013.01); *F25D 21/14* (2013.01); *F25D 2321/142* (2013.01)

(58) Field of Classification Search

CPC .. F25D 25/04; F25D 13/062; F25D 2321/142; F25D 13/06; F25D 21/065; F25D 3/11; F25D 3/127; F25D 13/067; F25D 3/126; F25D 21/06–21/14; A23L 3/375; A23L 3/361; B65G 45/12

See application file for complete search history.

(56) References Cited

U.S. PATENT DOCUMENTS

| | | | | | |
|---|---|---|---|---|---|
| 3,427,820 | A * | 2/1969 | Hart | A23L 3/375 62/307 |
| 4,173,127 | A * | 11/1979 | Sandberg | A23L 3/361 62/374 |
| 2010/0163370 | A1* | 7/2010 | McCormick | B65G 35/005 198/750.8 |
| 2018/0045454 | A1* | 2/2018 | Boyles | F25D 13/067 |

FOREIGN PATENT DOCUMENTS

| | | | | |
|---|---|---|---|---|
| FR | 2817612 | * | 6/2002 | F25D 3/11 |

OTHER PUBLICATIONS

Machine English language translation of FR2817612. Translated May 2023 (Year: 2002).*

* cited by examiner

*Primary Examiner* — Cassey D Bauer
(74) *Attorney, Agent, or Firm* — Joshua L. Cohen

(57) ABSTRACT

A method for removing moisture from an atmosphere within a freezer using a cryogen for freezing operations includes providing a freezing temperature with the cryogen at the atmosphere, reducing a temperature of the atmosphere with the cryogen for removing moisture in the form of droplets from the atmosphere, collecting the droplets on internal surfaces of the freezer, permitting the droplets to dwell for an amount of time in the atmosphere sufficient to freeze the droplets to become frozen droplets, and removing the frozen droplets from the freezer.

4 Claims, 1 Drawing Sheet

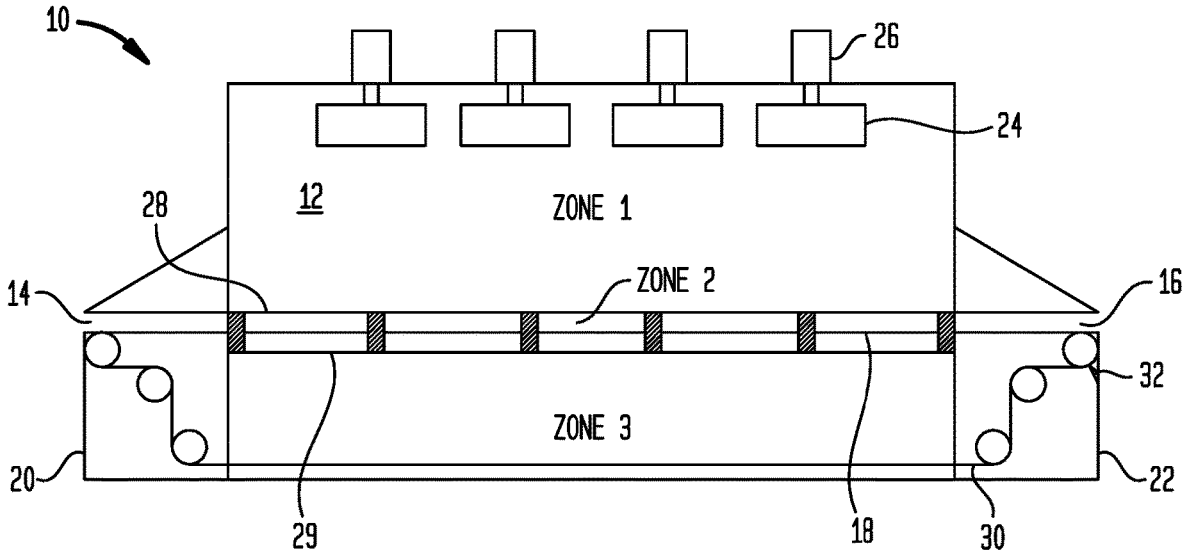
10
26
24
12
ZONE 1
28
ZONE 2
14
16
32
ZONE 3
20
22
29
18
30

IMPINGEMENT FREEZER WET COOL DOWN

BACKGROUND OF THE INVENTION

The present embodiments relate to impingement freezer apparatus and methods.

Industrial plants operating freezers, such as for example impingement freezers, must contend with avoiding the problem of an exhaust for the freezer becoming plugged or frozen and therefore, inoperable. This is caused by moisture in the exhaust ductwork freezing and thereby causing excessive snow and ice build-up in the ductwork. Plant freezer operators know that if and when a freezer is started in a completely dry state, i.e. there is no water vapor or standing water present in the freezer or ductwork which could become frozen, the freezer will run flawlessly throughout the operational day. Unfortunately, that "dry state" rarely if ever exists. This is because at the end of the operational day, and perhaps during the day, the freezer is cleaned with water or other hygienic solutions, to provide for operational, safety and hygienic conditions. Therefore, it is generally understood that for every operational day of the freezer, same is started in a wet condition such that moisture and water vapor in the freezer gets drawn or sucked into the freezer exhaust to become frozen and plug the exhaust.

This is especially so and occurs relatively quickly with cryogenic freezers, such as impingement freezers. The clogging exhaust reduces the efficiency of the freezer operations and eventually leads to cessation of operations until the exhaust can be sufficiently cleared of the frozen condensate built-up as excessive snow and ice in the exhaust. Downtime of the freezer leads to reduced operating efficiency of the freezer plant.

SUMMARY OF THE INVENTION

The solution to the exhaust problem of know freezers is a controlled cool down sequence that drops the moisture out of the air and condenses the moisture to prevent same from getting drawn or sucked into the exhaust. The moisture that is dropped out condenses instead on the belt and other freezer surfaces, but not in the exhaust. As the freezer gets colder, the droplets become frozen and large enough to be removed from the belt by a freezer scrapper and therefore, moisture is removed from the machine before it can be frozen in the exhaust.

There is therefore provided herein a method embodiment for removing moisture from an atmosphere within a freezer using a cryogen for freezing operations, which includes providing a freezing temperature with the cryogen at the atmosphere, reducing a temperature of the atmosphere with the cryogen for removing moisture in the form of droplets from the atmosphere, collecting the droplets on internal surfaces of the freezer, permitting the droplets to dwell for an amount of time in the atmosphere sufficient to freeze the droplets to become frozen droplets, and removing the frozen droplets from the freezer.

Another embodiment includes the removing at least a portion of the frozen droplets is with a conveyor belt moving through the atmosphere of the freezer.

Another embodiment includes scraping any of the frozen droplets from the conveyor belt after the conveyor belt leaves the atmosphere.

A further embodiment includes the freezer being an impingement freezer.

A still further embodiment includes the cryogen is a substance selected from the group consisting of nitrogen and carbon dioxide.

Due to the removal of this moisture, the freezer can be operated for a greater amount of time before experiencing any type of exhaust blockage from ice and snow. This increased continuity of operation provides for a well-balanced freezer (apparatus, machine) that produces a product, such as for example a food product, more efficiently and with higher quality.

BRIEF DESCRIPTION OF THE DRAWINGS

For a more complete understanding of the present invention, reference may be had to the following description of exemplary embodiments considered in connection with the accompanying drawing FIGURE, of which:

The FIGURE shows a side plan schematic view in cross-section of a freezer apparatus embodiment for performing the method embodiments according to the present invention.

DETAILED DESCRIPTION OF THE INVENTION

Before explaining the inventive embodiments in detail, it is to be understood that the invention is not limited in its application to the details of construction and arrangement of parts illustrated in the accompanying drawings, if any, since the invention is capable of other embodiments and being practiced or carried out in various ways. Also, it is to be understood that the phraseology or terminology employed herein is for the purpose of description and not of limitation.

In the following description, terms such as a horizontal, upright, vertical, above, below, beneath and the like, are to be used solely for the purpose of clarity illustrating the invention and should not be taken as words of limitation.

The drawings are for the purpose of illustrating the invention and are not intended to be to scale.

In general and using nitrogen (N2) for example as a cryogenic freezing gas in the freezer apparatus, there is provided an apparatus and method for reducing if not eliminating moisture in a freezer exhaust plenum, and such includes initially running the exhaust at as low a speed as possible, running internal blowers at not more than 20 Hz, and pausing belt movement until freezing temperatures are present at inlet and outlet of the freezer; the result being that the N2 cools the atmosphere within the freezer to cause moisture in same to drop out before the moisture can enter the exhaust(s). A majority of the moisture is collected on the belt and removed by scrapers at an outlet of the freezer. The inventive embodiments (i) prevent moisture from exiting the freezer into the exhausts where the moisture will freeze and clog the exhaust(s), and (ii) induces uniform cooling of the freezer zones. In effect, by substantially reducing if not preventing moisture from getting into the exhaust, the inventive embodiments insure that the exhaust will not become clogged or plugged-up with frozen condensate during operation of the freezer.

More specifically and referring to the FIGURE, during a freezer operation at full production load, an impingement freezer shown generally at 10 will be operating at a range of from −150° to −200° F. The freezer 10 includes a chamber 12 within for containing an internal atmosphere, an inlet 14 and an outlet 16 in communication with the chamber, and a conveyor belt 18 or belt extending from the inlet through the chamber to the outlet for transporting products, such as food products, through the freezer. The inlet 14 includes an inlet exhaust plenum 20, and the outlet 16 includes an outlet exhaust plenum 22. At least one fan 24 or blower is disposed for operation within the chamber 12. Each blower 24 is driven by a motor 26, which is usually mounted external to the chamber 12.

An upper impingement plate 28 or plates is mounted in the chamber 12 above the belt 18, and a lower impingement plate 29 or plates is mounted in the chamber below the belt. The impingement plate(s) 28,29 each extend through the chamber from the inlet 14 to the outlet 16.

The freezer 10 includes a plurality of atmospheric (air) zones: Zone 1 is located in the chamber 12 above the upper impingement plate 28; Zone 2 is a space located in the chamber between the impingement plate(s) 28 and the impingement plate(s) 29; and Zone 3 is located in the chamber below the lower impingement plate(s) 29. The Zone 3 provides space for a belt return region 30 of the belt 18 so that same can be run as a continuous loop. A belt scraper 32 may also be mounted in the Zone 3 proximate the belt 18.

The Zones 1 and 3 are each at a pressure of 2-3 inches of water. The Zone 2 is at a pressure of zero (0) to slightly negative pressure. The Figure shows the Zones 1-3 of the freezer 10 that contain the moisture which can become frozen in the exhaust plenums 20,22, and how such moisture can be prevented from moving into the exhaust plenums.

In operation and using for example N2 as the cryogen substance for freezer operations (carbon dioxide (CO2) can also be used), the process embodiment begins with the exhaust plenums 20,22 being run as low as possible, i.e. for example at not greater than 20 to 30 Hz. The blowers 24 are set to operate at not greater than 20 Hz, The purpose of this starting operation is to stir the moisture in the air of the chamber 12 as little as possible, while also inducing even and uniform cooling of the chamber 12. The belt 18 is paused or stopped until a desired freezing temperature is achieved for each of the inlet 14 and the outlet 16 of the freezer 10. This initial stage allows the N2 to cool any air inside the chamber 12, which then removes or drops moisture out of the air. The moisture in the form of droplets, although in other embodiments the moisture can be in the form of a mist and/or fog, is collected on all surfaces of the freezer including the belt 18. Due to a large surface area of the belt 18 immediately exposed to the moisture, most of the moisture is deposited on or collected by the belt, which in turn during movement transports the moisture from the chamber 12 through the outlet 16 and out of the freezer 10.

When a temperature of the chamber 12 drops below freezing, the belt 18 can be activated for a dwell time of for example 2 minutes, and during such dwell time the water droplets that were deposited on the belt 18 become frozen, after which such is scrapped off at the outlet 16 by the belt scraper 32. The belt scraper 32 may be positioned just beneath the belt 18 where same wraps around a pulley to begin the belts return travel in the continuous loop that is the belt.

The dwell time of the belt 18 is important, and refers to a period of time of, for example, two (2) minutes, which is the amount of time it will take an object (such as a food article) to move through the freezer 10 on the belt. Using a meat patty as an example, placing the patty on the belt 18 at the inlet 14, it would take approximately two (2) minutes for the patty to move through the freezer Zone 2 and be discharged at the outlet 16. The importance of the designated dwell time is to prevent the belt 18 from causing excessive and therefor detrimental stirring of the atmosphere in the chamber 12 when the belt is transiting the chamber with the food product (meat patty). In effect, operating the belt 18 at an excessive rate of speed impacts gas movement inside the freezer chamber 12, and causes the gas to flow to the exhausts 20,22 where it can become frozen and clog the exhausts. By controlling movement of the belt 18 at a select speed through the chamber 12, such belt control effectively prevents moisture from flowing into the exhausts 20,22 and freezing in same. The preferred dwell time is maintained until the freezer 10 hits a desired set point for an operation to freeze the product, at which time the speed of the belt 18, the exhaust 20,22 and the blower 24 can all be set accordingly to freeze the products in accordance with the order placed with the plant operator.

The process embodiments above achieve an operational stage for the freezer 10 which does not permit moisture to exit the chamber 12 into the exhaust plenums 20,22. The reduced speeds of the exhaust and the blowers 24 do not force the moisture out of the chamber 12. The Zones 1 and 3 contain a majority of the moisture—with moisture in the Zone 3 usually pooling on a floor of the chamber 12, while moisture in the Zone 1 is usually found on an interior surface of a wall for the Zone 1 and in the air of the chamber 12 at the Zone 1. Regarding the Zone 2, keeping the fan speed reduced permits only little air movement through the impingement plates 28,29 which allows the moisture to be deposited on and stick to the belt 18 and then be frozen and removed on the belt out of the freezer. The present process substantially reduces if not eliminates moisture in the Zones migrating toward and out of the exhaust plenums 20,22.

It will be understood that the embodiments described herein are merely exemplary, and that a person skilled in the art may make variations and modifications without departing from the spirit and scope of the invention. All such variations and modifications are intended to be included within the scope of the invention as described and claimed herein. It should be understood that the embodiments described above are not only in the alternative, but can be combined.

What is claimed is:

1. A method for removing moisture from an atmosphere within a freezer using a cryogen for starting freezing operations, comprising:

providing the cryogen to the atmosphere in the freezer;

reducing a temperature of the atmosphere with the cryogen to be at a freezing temperature for removing moisture in the form of droplets from the atmosphere and collecting the droplets on internal surfaces of the freezer and on a conveyor belt arranged to move through the atmosphere;

pausing movement of the conveyor belt for a dwell time sufficient for the freezing temperature to be present at an inlet and an outlet of the freezer to freeze the droplets into frozen droplets before the moisture in the atmosphere enters an exhaust from the freezer; and removing the frozen droplets at the outlet of the freezer on the conveyor belt moving from the atmosphere through the outlet.

2. The method of claim 1, further comprising scraping any of the frozen droplets from the conveyor belt at an exhaust plenum after the conveyor belt leaves the atmosphere.

3. The method of claim 1, wherein the freezer is an impingement freezer.

4. The method of claim 1, wherein the cryogen is a substance selected from the group consisting of nitrogen and carbon dioxide.

* * * * *